US006630025B2

(12) United States Patent
Nonomura et al.

(10) Patent No.: US 6,630,025 B2
(45) Date of Patent: Oct. 7, 2003

(54) COATING APPARATUS

(75) Inventors: Hiromi Nonomura, Saitama-ken (JP); Yasuo Takamizu, Tokyo (JP)

(73) Assignees: Nissan Motor Co., Ltd., Kanagawa-ken (JP); Taikisha Ltd., Tokyo (JP)

( * ) Notice: Subject to any disclaimer, the term of this patent is extended or adjusted under 35 U.S.C. 154(b) by 12 days.

(21) Appl. No.: 09/804,064

(22) Filed: Mar. 13, 2001

(65) Prior Publication Data

US 2002/0007788 A1 Jan. 24, 2002

(30) Foreign Application Priority Data

Mar. 15, 2000 (JP) ..... P2000-072426
Feb. 14, 2001 (JP) ..... P2001-036482

(51) Int. Cl.[7] ..... B05C 5/00

(52) U.S. Cl. ..... 118/300; 118/621; 427/458; 427/426; 427/421; 239/706

(58) Field of Search ..... 118/621, 300; 427/458, 580, 426, 421, 427; 239/704–707, 106, 114, 116

(56) References Cited

U.S. PATENT DOCUMENTS 4,020,866 A * 5/1977 Wiggins ..... 137/592
4,137,623 A * 2/1979 Taylor ..... 29/433
5,192,595 A * 3/1993 Akeel et al. ..... 427/421

FOREIGN PATENT DOCUMENTS

JP 2790153 6/1998

* cited by examiner

*Primary Examiner*—J. A. Lorengo
*Assistant Examiner*—Michelle Aavido Lazor
(74) *Attorney, Agent, or Firm*—McDermott, Will & Emery

(57) ABSTRACT

A coating apparatus includes: a coating gun to which a voltage is applied; a coating hose for leading a coating material to the coating gun; a piston provided so as to be capable of water-tightly sliding in the coating hose; and driving means for moving the piston in the coating hose. The coating material is injected into a front part of the piston and the piston is moved toward the coating gun at the time of coating.

9 Claims, 9 Drawing Sheets

COATING APPARATUS

BACKGROUND OF THE INVENTION

1. Field of the Invention

The present invention relates to a coating apparatus suitable for applying a high voltage to a conductive coating material such as a water base coating material to perform coating. More particularly, it relates to an apparatus for supplying a non-conductive coating material and a conductive coating material.

2. Description of the Related Art

A water base coating material can be readily disposed since it does not contain an organic solvent, and it is easy on an environment. Further, it does not contain a dangerous material such as an organic solvent, and hence it is excellent in prevention of fire accidents. Therefore, there is increased a demand as an intermediate coating material or a finish base coating material in place of or together with an organic solvent base coating material.

In case of applying a high voltage to such a water base coating material to perform electrostatic coating, an external application system or an insulation mechanism for a coating circuit (which will be hereinafter referred to as a voltage block system) must be employed, in contrast to the organic solvent base coating material (Japanese Patent No. 2790153).

SUMMARY OF THE INVENTION

An external application system applies a voltage from an external electrode to coating particles which have been sprayed and atomized by a coating machine so that the coating particles are charged with electricity. Since the coating particles are not contact-charged in a coating circuit, the electricity scarcely flows through the coating material.

However, the external application system has the worse coating deposition efficiency than that of the voltage block system, which leads to a problem that an amount of coating material to be used is increased as much as approximately 10%. Further, a coating gun is apt to splotched in principle, and a defect such as irregularity of a coating material consequently tends to occur. Thus, a frequency of cleaning the coating gun must be increased, which may lower the productivity.

On the other hand, as a conventional voltage block system, there is known an intermediate coating tank insulation system which lifts an intermediate coating tank set on a booth side by an insulation mounting so that an area from the coating machine to the intermediate coating tank becomes a charging range.

However, when a number of paint colors is large, a large space is required on the booth side. Further, when color change is frequently performed or an amount of coating material to be used is large, the working property is deteriorated.

In view of the above-described problems in the prior art, an object of the present invention is to provide an inexpensive coating apparatus which is superior in the insulating property and the color change working property and can be applied to both a conductive coating material and a non-conductive coating material.

To achieve this aim, there is provided a coating apparatus comprising: a coating gun to which a voltage is applied; a coating pipe for leading a coating material to the coating gun; a piston provided in the coating pipe so as to be capable of water-tightly sliding; and a drive portion for moving the piston in the coating pipe, the coating material being injected into a front part of the piston and the piston being moved toward the coating gun at the time of coating.

Further, to achieve the above aim, there is provided a coating apparatus comprising: a coating gun to which a voltage is applied; a coating pipe for leading a coating material to the coating gun; a cylinder provided in the middle of the coating pipe; a piston provided in the cylinder so as to be capable of water-tightly sliding; and a drive portion for moving the piston in the cylinder, the coating material being injected into a front part of the piston and the piston being moved toward the coating gun at the time of coating.

Moreover, to achieve the above aim, there is provided a coating apparatus comprising; a coating gun to which a voltage is applied; a first coating pipe for leading a coating material to the coating gun; a first piston provided in the first coating pipe so as to be capable of water-tightly sliding; a first drive portion for moving the first piston in the first coating pipe; a second coating pipe for supplying the coating material to a front part of the first piston; a second piston provided in the second coating pipe so as to be capable of water-tightly sliding; a second drive portion for moving the second piston in the second coating pipe; and an opening/closing valve provided to a connection portion between the first coating pipe and the second coating pipe, the coating material being injected to a front part of the second piston at the time of coating, the second piston and the first piston being moved toward the coating gun.

Furthermore, to achieve the above aim, there is provided a coating apparatus comprising: a coating gun to which a voltage is applied; a coating pipe for leading a mixed coating material containing at least two kinds of coating materials to the coating gun; a piston provided in the coating pipe so as to be capable of water-tightly sliding; a drive portion for moving the piston in the coating pipe; and a mixer for mixing the at least two kinds of coating materials to supply the mixed coating material to the coating pipe.

In addition, to achieve the above aim, there is provided a coating apparatus comprising: a coating gun which has at least two trigger valves and to which a voltage is applied; at least two coating pipes for respectively leading the at least two kinds of coating materials to the trigger valves of the coating gun; at least two pistons provided in the at least two coating pipes so as to be capable of water-tightly sliding; and at least two drive portions for respectively moving the at least two pistons in the coating pipes.

Further, to achieve the above aim, there is provided a coating apparatus comprising: a coating gun to which a voltage is applied; a mixer for mixing at least two kinds of coating materials and supplying an obtained mixed coating material to the coating gun; at least two coating pipes for leading the at least two kinds of coating materials to the mixer; at least two pistons provided in the at least two coating pipes so as to be capable of water-tightly sliding; and at least two drive portions for respectively moving the at least two pistons in the coating pipes.

The nature, principle and utility of the invention will become more apparent from the following detailed description when read in conjunction with the accompanying drawings.

DESCRIPTION OF THE PREFERRED EMBODIMENTS

Preferred embodiments according to the present invention will now be described hereinafter with reference to the accompanying drawings.

<First Embodiment>

Figure 1:
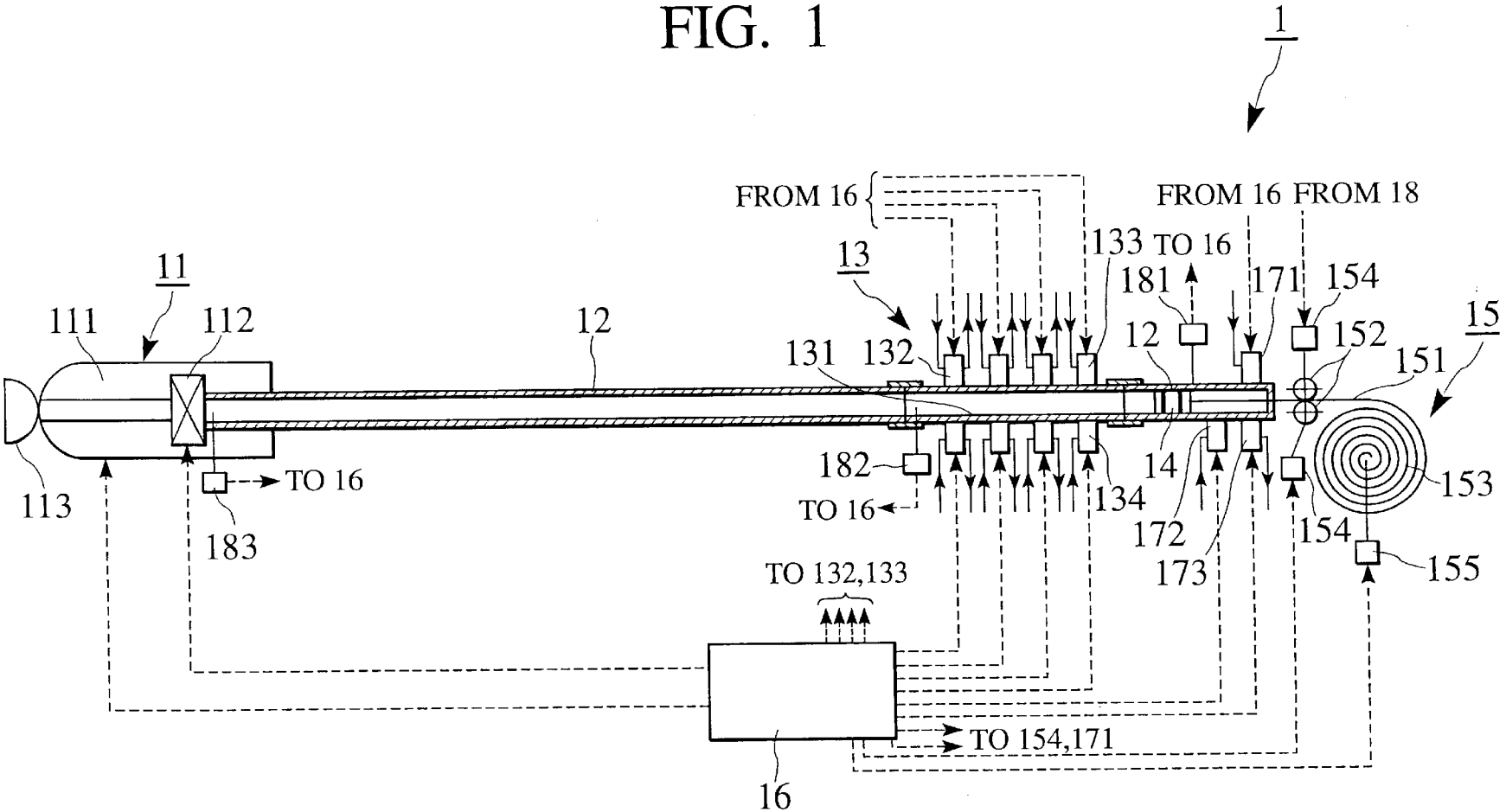
FIG. 1 is a schematic block diagram showing an embodiment of a coating apparatus according to the present invention.

As shown in FIG. 1, a coating apparatus 1 according to this embodiment includes: a bell-shaped electrostatic coating gun 11 to which a high voltage of −90 kV to −60 kV is applied; a coating pipe 12 (which is also referred to as a coating hose 12) for leading a coating material to the coating gun 11; a color change valve unit 13 which is provided in the middle of the coating pipe 12 and performs a color change operation for a coating material; a piston 14 which can water-tightly slide in the coating pipe 12 and a manifold 131 (which corresponds to a common flow path according to the present invention) of the color change valve unit 13; and driving means for moving the piston 14.

The bell-shaped electrostatic coating gun 11 has a trigger valve 112 in a gun main body 111. When the trigger valve 112 opens based on a command signal from a later-described controller 16, the coating material supplied from the coating hose 12 reaches a bell cup 113 provided at the end of the gun main body 111. When the bell cup 113 rotates at a high speed, the coating material is sprayed in all directions while being atomized from an end edge of the bell cup 113. In FIG. 1, illustration of shaping air is omitted, which adjusts a pattern of coating particles sprayed from the end edge of the bell cup 113.

It is to be noted that the coating apparatus according to the present invention is not restricted only to the bell-shaped electrostatic coating gun but an air spray type electrostatic coating gun can be also adopted.

In the coating hose 12 according to this embodiment, its left end in the drawing is connected to the trigger valve 112 of the coating gun 11 and its right rear end is closed except a through hole of a cable 151. As will be described later in connection with FIG. 3, when the coating gun 11 is mounted to, for example, a coating robot R, the coating hose 12 is bent with a work posture of the coating robot R. It is, therefore, preferable that the coating hose 12 is flexibly made of a nylon-based, a polytetrafluoroethylene-based or an urethan-based resin so that the coating hose itself can have the ductility and the piston 14 can smoothly move in the coating hose even when the coating hose is bent. If the coating pipe 12 can be straightened at least within a moving range of the piston 14, however, the coating hose can be made up of metal such as stainless. However, the outside of metal such as stainless must be insulated by using a resin and the like.

Figure 2:
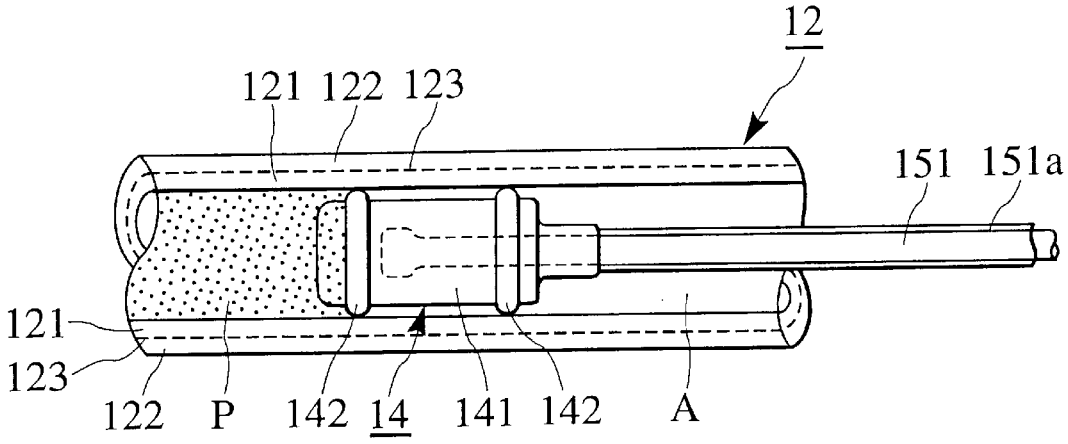
FIG. 2 is a cross-sectional view showing an example of a piston according to the present invention.

Further, although the coating pipe according to the present invention is not restricted to a certain type, it is preferable that the coating hose 12 is formed by an internal layer 121 consisting of a material superior in the abrasion resistance; a reinforcing member 123 for preventing expansion due to a pressure in the pipe; and external layer 122 which is provided so as to surround these members and constituted by a flexible material which can follow the curve of the coating hose 12, as shown in FIG. 2.

It is to be noted that a length of the coating hose 12 can be appropriately adjusted in accordance with an amount of the coating material to be used. For example, the length of the coating hose 12 can be set longer when an amount of the coating material to be used is large, and it can be set shorter when an amount of the coating material to be used is small.

The color change valve unit 13 is provided in the middle of the coating hose 12 and water-tightly connected to each end of the manifold 131 and the coating hose 12 by joints. To the color change valve unit 13 shown in the drawing are provided a selector valve 132 to which a different coating material is supplied from a non-illustrated coating material supply source, a selector valve 133 to which compressed air is supplied, and a selector valve 134 to which washing de-ionized water (washing thinner in case of a non-conductive coating material, and so forth) is supplied. In the drawing, six selector valves on the left-hand side are the selector valves 132 to which the coating material is supplied in the drawing. A number of the selector valves 132 may be more or less than six and can be appropriately increased/decreased under various conditions such as a number of coating colors of an applied coating line and the like. Incidentally, the compressed air supplied to the selector valve 133 is used for thrusting out the coating material or the washing de-ionized water at the time of color change, and the washing de-ionized water supplied to the selector valve 134 is used for cleaning the pipe at the time of color change.

As to the color change valve unit 13 according to this embodiment, the internal diameter of the manifold 131 is so formed as to be substantially equal to that of the coating hose 12. This enables the piston 14 to smoothly move from the right end to the left end of the coating hose 12 through the manifold 131 of the color change valve unit 13.

Although not restricted in the present invention, when a conductive coating material is used as the coating material in particular, it is preferable that the manifold 131 of the color change valve unit 13 is made up of an insulating material such as a synthetic resin. When the manifold 131 is formed of a conductive material such as metal, an electric current may leak from the manifold 131 and the selector valves 132, 133 and 134 to the coating material supply source side thorough the conductive coating material.

In particular, the coating apparatus 1 according to this embodiment is provided with the piston 14 which can water-tightly slide from the right end to the left end of the coating hose 12 through the manifold 131 of the color change valve unit 13 in these members, and the driving means 15 for moving the piston 14 at an appropriate position and an appropriate speed.

As shown in FIG. 2 writ large, the piston 14 is constituted by mounting two O rings 142 which are formed of an insulating material and prevent the coating material from leaking on a piston main body 141 similarly consisting of an insulating material. A length of the piston main body 141 in the axial direction is shortened as much as possible so that the piston 14 can smoothly move even when the coating hose 12 is bent. It is preferable to constitute the piston main body 141 by an insulating material such as nylon which is not degraded by water or a solvent and the O ring 142 by a material such as rubber which has the appropriate elasticity and is superior in the abrasion resistance and the solvent resistance.

The O ring 142 assures water-tightness of the coating material and the like in front or back of the piston 14 and has a function for improving the sliding property of the piston 14. Also, it has a function for scraping off the coating material having a previous color which has adhered to the inner wall of the coating hose 12 at the time of color change.

When the coating material is injected into the front part of such a piston 14 and the piston is moved toward the coating gun 11, the conductive coating material which has adhered to the inner wall of the coating hose 12 is also scraped off toward the front part by the O ring 142, and whereby only air exists at the rear of the piston 14. Therefore, even if a high voltage is applied to the coating gun 11, the voltage is blocked in front or back of the piston 14, thereby preventing an electric current from leaking toward the rear end of the coating hose 12.

The driving means 15 for moving the piston 14 includes: a cable 151 having an end fixed to the piston main body 141; a pair of thrusting rollers 152 and 152 which sandwich the cable 151 and rotate; and a pulling device 153 for taking up the cable 151.

The thrusting rollers 152 and 152 rotate by respective drive motors 154 and 154 and give the drive force to the cable 151 mainly when the piston 14 moves toward the coating gun 11. Further, these rollers 152 and 152 release the action for holding the cable 151 when the piston 14 returns in a direction away from the coating gun 11. The thrusting roller 152 controls a quantity of the coating material to be thrusted out with movement of the piston 14, thereby in this embodiment requiring no gear pump which is necessary in the prior art. Further, since a pair of the thrusting rollers 152 and 152 have a mechanical structure that they sandwich the cable 151 to forward move the piston 14, the thrusting roller 152 slips when a voltage reaches such a high value as that the coating hose 12 blows out in principle. Therefore, the safety can be improved.

On the other hand, the pulling device 153 rotates in both forward and backward directions by the drive motor 155. When the piston 14 moves toward the coating gun 11, the pulling device 153 rotates so that the cable 151 runs out in the same direction. Further, the pulling device 153 functions by rotating in the reverse direction, when the piston 14 returns in a direction away from the coating gun 11. At this time, the thrusting roller 152 becomes free with respect to the cable 151 as described above, increase in the rotational speed of the pulling device 153 shortens the time required for returning the piston 14.

Although it is preferable to constitute the cable 151 by an insulating material, it is desirable to form an insulating coating layer 151*a* on an outer periphery of the cable 151 as shown in FIG. 2 so that the leakage of the electric current due to the residual moisture, water, coating material and others in the rear portion of the piston 14 can be prevented, when a metal (conductive) cable is used as the cable 151 in order to enhance the rigidity and the durability.

In order to clean the inside of the coating hose 12 positioned at the rear of the piston 14, three selector valves 171, 172 and 173 are provided at the right end of the coating hose. The washing thrusting air is supplied to the selector valve 171, and the washing thinner is supplied to the selector valve 172. The selector valve 173 is a dump valve. The inside of the coating hose at the rear of the piston 14 is mainly filled with the air, and only the slightly leaked coating material exists therein. The coating hose 12 at the rear of the piston 14, therefore, does not have to be cleaned by the selector valves 171 to 173 every time a color is changed, but it may be cleaned according to needs.

A control signal from the controller 16 controls application of a high voltage to the coating gun 11, switching of the trigger valve 112, switching of the respective selector valves 132, 133 and 134 of the color change valve unit 13, switching of the selector valves 171, 172 and 173, the operation of the drive motor 154 of the thrusting roller 152, and the operation of the drive motor 155 of the pulling device 153.

To the controller 16 are inputted a control signal fed from a non-illustrated management device as well as a detection signal from position sensors 181, 182 and 183 for detecting a current position of the piston 14. The position sensor 181 supplies a detection signal when the piston 14 is situated at a rearmost end which is a position at the rear of the color change valve unit 13. The position sensor 182 supplies a detection signal when the piston 14 is positioned slightly before the color change valve unit 13. Further, the position sensor 183 supplies a detection signal when the piston 14 is situated at the foremost position which is a position immediately before the trigger valve 112 of the coating gun 11. The rearmost end position of the piston 14 detected by the position sensor 181 is referred to as a backward limit position; the position of the piston 14 detected by the position sensor 182, an application enabling position; and the foremost position of the piston 14 detected by the position sensor 183, a forward limit position hereinafter.

Figure 3:
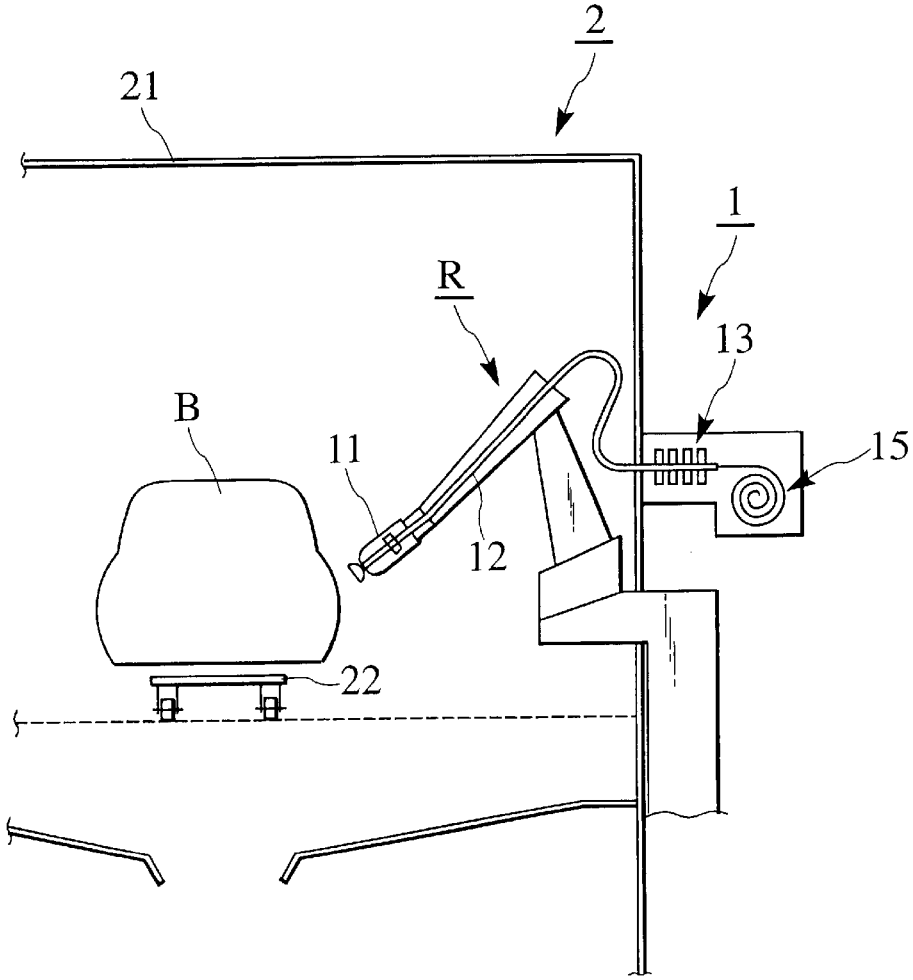
FIG. 3 is a schematic block diagram showing a use of the coating apparatus according to the present invention.

The coating apparatus 1 according to this embodiment having such an arrangement is mounted in a coating robot R to be used in the coating line 2 as shown in FIG. 3, for example. In the drawing, "21" denotes a coating booth; "22", a coating cart; and "B", a vehicle body as a coating object.

In this case, it is preferable to set at least the driving means 15 outside the coating booth, and this is possible in the coating apparatus 1 according to this embodiment. This is based on the following reason. That is, no problem occurs when all the coating materials used in the coating booth 21 are non-solvent based materials (non-dangerous materials). However, in case of a mixed line using a solvent based material and a non-solvent based material, explosion protection must be applied to the drive motor or the electric wiring used in the coating apparatus, which leads to increase in the facility cost. However, when the drive motors 154 and 155 requiring explosion protection are set outside the coating booth 21, explosion protection does not have to be applied even in case of the mixed line using the solvent based coating material, thereby enabling lower costs. Further, setting the driving means 15 outside the coating booth 21 can improve the work property of the maintenance and the inspection.

The operation will now be described.

Figure 4:
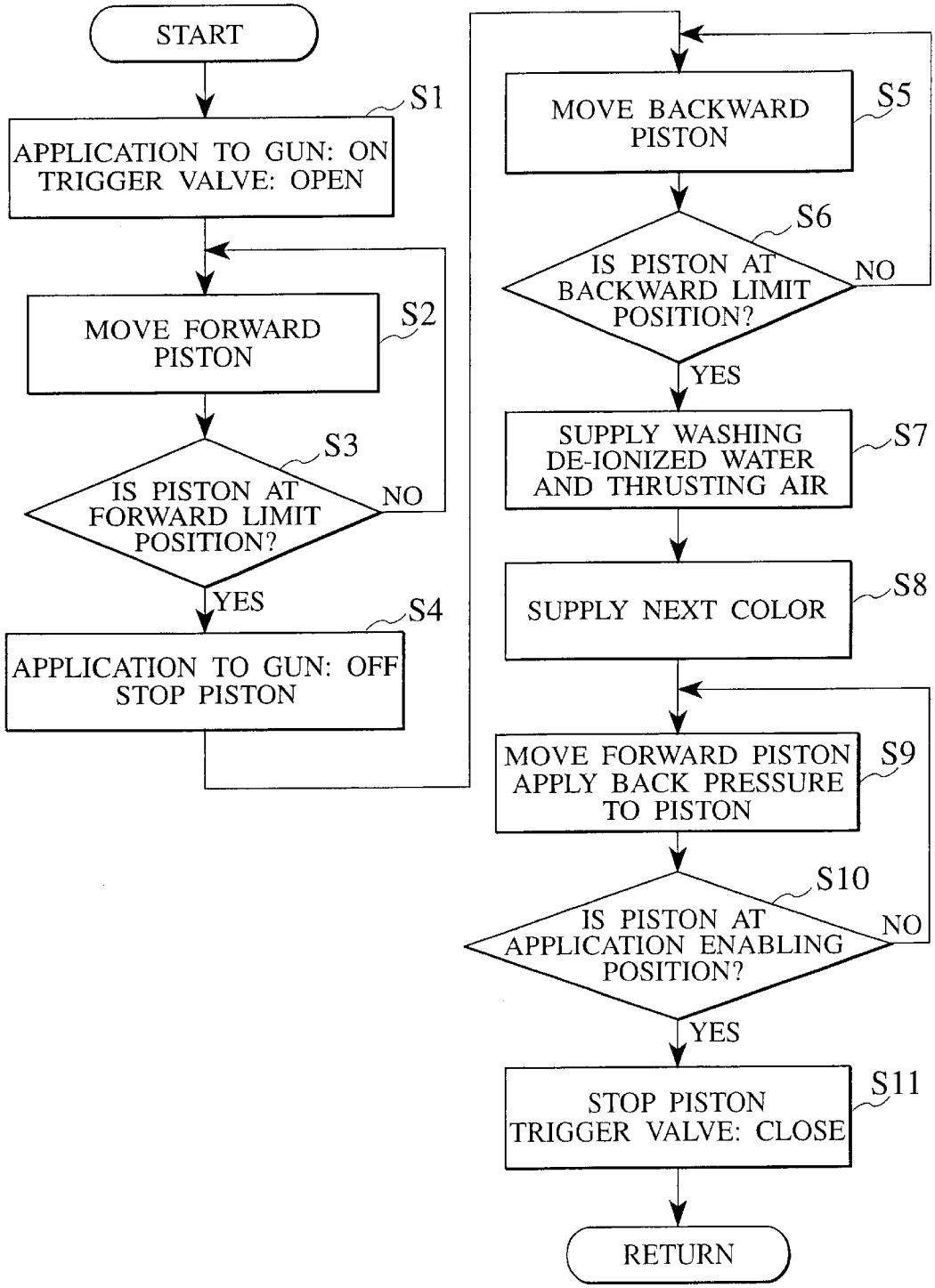
FIG. 4 is a flowchart showing an example of the operation of the coating apparatus according to the present invention.

FIG. 4 shows a procedure of one cycle in which the coating material is supplied to the coating apparatus 1 according to this embodiment and the coating material is applied to the coating object B from the coating gun 11 to then wait for the next coating object B. Coating first starts from the state in which the piston 14 is set at the application enabling position. In this state, the piston 14 is situated slightly before the color change valve unit 13, and the coating material P to be applied to the coating object B is filled in the coating hose 12 extending from the piston 14 to the bell cup 113. This fill is substantially equal to an amount of the coating material applied by the coating gun 11. Air A is filled in the coating hose 12 at the rear of the piston 14.

In this state, a high voltage is applied to the coating gun 11, and the trigger valve 112 is opened (step 1). As a result, although an electric current flows from the coating gun 11 through the conductive coating material P, the air A is filled in the rear part of the piston 14. This demonstrates a so-called voltage block function, thereby being insulated with the piston 14.

When the trigger valve 112 opens, the thrusting roller 152 is nearly simultaneously operated to run out the cable 151 so that the piston 14 moves toward the coating gun 11 (step 2). Incidentally, although the opening operation of the trigger valve 112 is carried out nearly simultaneously with the thrusting operation of the piston 14, the bell cup 113 of the coating gun 11 may turn sideways or diagonally upward depending on a posture of the coating robot R. Therefore, in order to stabilize an amount of first discharge or a spraying pattern, it is preferable to perform the thrusting operation of the piston 14 prior to the opening operation of the trigger valve 112 by approximately 0.1 to 0.3 seconds. By doing so, there can be obtained means effective for taking steps to meet dripping of the coating material from the end of the feed tube in case of the rotary spraying coating gun in particular.

A thrusting speed at which the piston 14 is thrust out is concerned with an amount of discharge from the bell cup 113. That is, an amount of discharge increase when the thrusting speed becomes higher, and an amount of discharge decreases when the thrusting speed becomes lower. An appropriate thrusting speed is, therefore, fed from the controller 16 to the driving means 15.

When the piston 14 tries to move toward the coating gun 11, the coating material P is supplied to the coating gun 11 as described above. However, when the piston 14 reaches the forward limit position immediately before the trigger valve 112 and then the position sensor 183 detects this, the thrusting roller 152 and the pulling device 153 are stopped, and application of a high voltage to the coating gun 11 is also stopped to terminate application of the coating material to the coating object B (steps 3 and 4).

The subsequent steps correspond to the color change cycle. At first, since the piston 14 is situated at the forward limit position, the thrusting rollers 152 and 152 are released to be free and the pulling device 153 is rotated in the reverse direction so that the piston 14 is retracted (step 5). Incidentally, when the piston 14 is retracted, air in the rear part of the piston 14 (right-hand side in the drawing) is compressed, and it is hence desirable to previously open the dump valve 173 to smooth the operation of the piston 14.

In this embodiment, when the piston 14 is retracted, the thrusting roller 152 is released to be free and the piston 14 is moved by only the pulling device 153, so that the piston 14 can be returned to the backward limit position in a short period of time, thereby shortening the color change time.

When the position sensor 181 detects that the piston 14 has reached the backward limit position (step 6), the selector valves 133 and 134 of the color change valve unit 13 are alternately opened and closed, and the washing de-ionized water and the thrusting air are supplied into the coating hose 12 in front of the piston 14 (step 7). For example, when the piston 14 returns to the backward limit position, since the coating material P remains in the coating hose from the trigger valve 112 to the bell cup 113, the selector valve 133 is first opened to supply the thrusting air to the coating hose 12. Further, the remaining coating material P is thrusted out from the bell cup 113. Subsequently, the selector valve 134 is opened to supply the washing de-ionized water into the coating hose 12 and the inner wall of the coating hose 12 is cleaned. Moreover, the selector valve 133 is again opened to supply the thrusting air into the coating hose 12. Then, the remaining washing de-ionized water is thrusted out from the bell cup 113. These operations are repeated to clean the inside of the coating hose 12 positioned in front of the piston 14.

When the inside of the coating hose 12 becomes clean, any of the selector valves 132 in the color change valve unit 13 is opened to supply the next coating material P having a different color into the coating hose 12 in front of the piston 14 (step 8). Here, the opening/closing timing of the selector valve 132 is controlled in accordance with an amount of the coating material to be used, thereby obtaining a fill suitable for that coating color. This can obtain a minimum amount of the coating material which remains to be wasted after completion of coating.

Upon supplying the next coating material P having a different color, the thrusting rollers 152 and 152 and the pulling device 153 are driven to move forward the piston 14 (step 9). At this time, the rear part of the piston 14 forms a vacuum and hence the piston 14 can not smoothly move, the selector valve 171 is simultaneously opened to supply the compressed air to the rear part of the piston 14 (step 9). It is to be noted that the rear part of the piston may be opened to the air by opening the dump valve 173 instead. When the selector valve 171 is opened to supply the compressed air to the rear part of the piston 14, a vacuum can be prevented from being formed, and the piston 14 is pushed against the coating gun 11 by the behavior of the compressed air, thereby further smoothing the operation of the piston 14. It is to be noted that a liquid can substitute for the compressed air but the compressed air is particularly preferable.

When the position sensor 182 detects that the piston 14 has reached the application enabling position slightly before the color change valve unit 13 (step 10), the thrusting roller 152 and the pulling device 153 are stopped. Further, the trigger valve 112 is closed to wait for a coating start signal for the next color (step 11).

As described above, in the coating apparatus 1 according to this embodiment, the piston 14 is provided in the coating hose 12, and the conductive coating material P is supplied to the front part of the piston 14 to be thrusted out toward the coating gun 11. The air layer is, therefore, formed at the rear of the piston 14, and this demonstrates a so-called voltage block function. Thus, an existing bell-shaped electrostatic coating gun and the like having the high coating efficiency can be utilized without making any change, both adoption of the conductive coating material and improvement in the coating efficiency can be attained. Moreover, since the existing coating gun can be used as it stands, replacement of the coating gun or alteration cost will be no longer necessary.

Additionally, controlling the speed for pushing the piston can readily adjust an amount of discharge, and the piston can substitute for an expensive device such as a gear pump which is necessary in the prior art, thereby lowering the facility cost.

For the color change operation, since the coating material can be thrusted out to the trigger valve by using the piston, an amount of the coating material wasted at the time of color change can be minimum, which is advantageous in reduction in the coating material cost and the environmental measure such as the waste liquid disposal.

An amount of the coating material to be used (an amount of discharge) for each coating gun differs in accordance with a change in the coating cycle time, a difference in coating objects, a difference in coating colors due to coating material solid contents, a difference in the required quality such as a film thickness. However, according to the coating apparatus of this embodiment, the length of the coating hose 12 is set in conformity to the maximum amount of the coating material to be used in advance, and the coating material having a required amount is filled to be applied. It is, thus, possible to be receptive with respect to fluctuations in an amount of the coating material to be used.

Moreover, when the color change valve unit is provided in the middle of the coating pipe, it is possible to sufficiently cope with multiple coating colors or high frequency of color change. Moreover, since the unit is not restricted to the booth side tank, a large amount of the coating material can be successfully processed.

The coating apparatus according to this embodiment can be applied to the conductive coating material as well as the non-conductive coating material.

In addition, since all of the coating material in the coating hose is thrusted out by the piston, an area which must be cleaned is extremely reduced, thereby enabling cleaning in the system within a short period of time. As a result of high cleanness, color change of the conductive coating material and the non-conductive coating material can be performed in the same coating apparatus.

Further, according to the coating apparatus of this embodiment, since the coating material is filled in the coating hose immediately before performing coating, pigment sedimentation does not occur even in the case of a metallic coating material or a mica coating material. When this coating apparatus is applied to the coating gun using a cartridge, pigment sedimentation can be eliminated.

<Second Embodiment>

Figure 5:
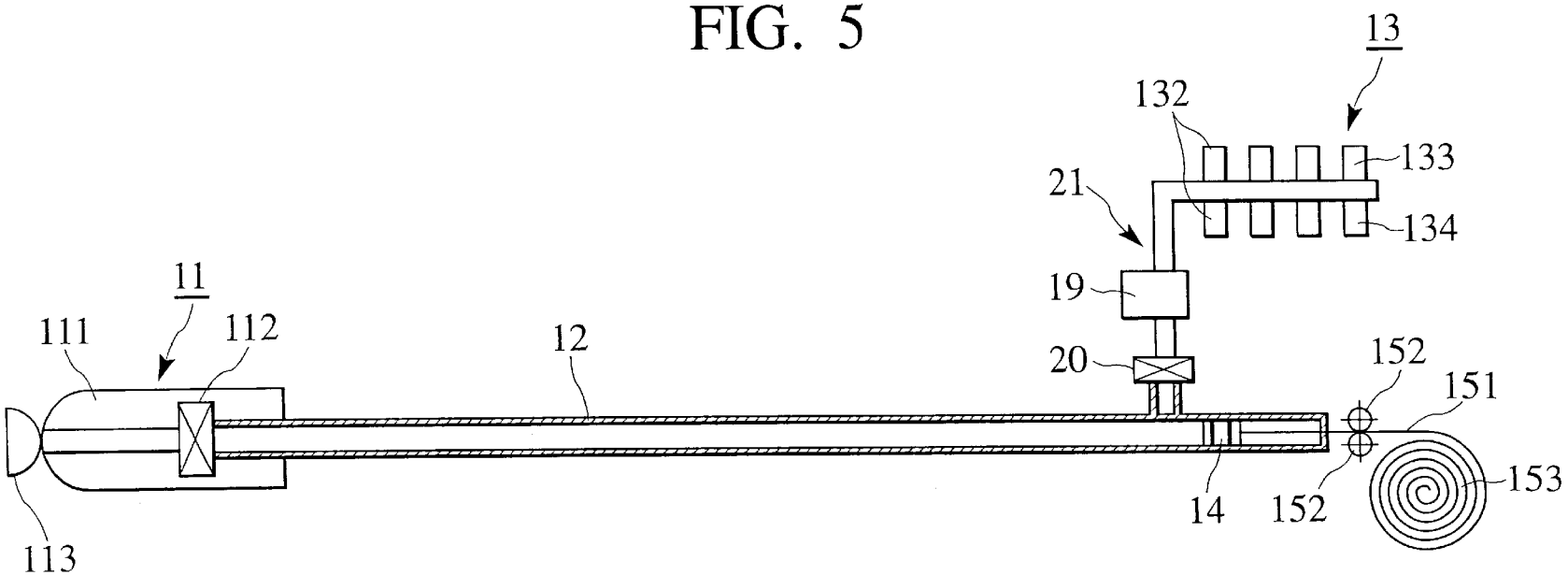
FIG. 5 is a schematic block diagram showing another embodiment of a coating apparatus according to the present invention.

FIG. 5 is a schematic block diagram showing another embodiment of the coating apparatus according to the present invention. Although an amount of the coating material filled in the coating hose 12 is controlled by the opening/closing timing of the selector valve 132 in the color change valve unit 13 in the first embodiment, a flow meter 19 is provided in order to accurately control a fill of the coating material P in the second embodiment. That is, a branch pipe 21 is provided in front of the backward limit position of the piston 14 in the coating hose 12, and the color change valve unit 13 is disposed to this pipe. The flow meter 19 and an opening/closing valve 20 are provided between the color change valve unit 13 and the coating hose 12. The opening/closing valve 20 is opened when the coating material and the like are supplied from the color change valve unit 13 to the coating hose 12, and closed when the piston 14 moves forward after filling the coating material, thereby preventing the coating material from flowing back.

In this manner, by measuring an amount of the coating material supplied from the color change valve unit 13 by using the flow meter 19, even if a fill is uneven due to a fluctuation in viscosity of the coating material and the like, such unevenness can be avoided. Consequently, the coating quality can be stabilized and an amount of the coating material to be wasted can be reduced.

<Third Embodiment>

Figure 6:
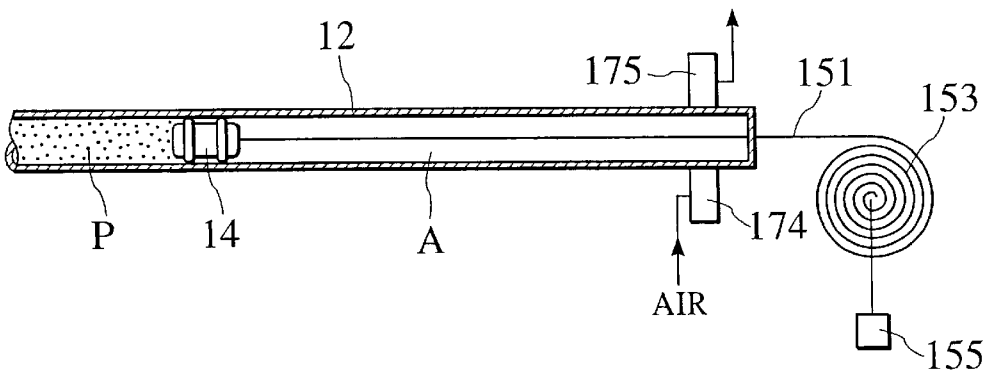
FIG. 6 is a schematic block diagram showing a primary part of still another embodiment of the coating apparatus according to the present invention.

FIG. 6 is a schematic block diagram showing a primary part of still another embodiment of the coating apparatus according to the present invention. Although the compressed air is supplied from the rear part of the piston 14 via the selector valve 171 to further smooth the forward movement of the piston 14 in the first embodiment, it is possible to give the forward drive force of the piston 14 by only the compressed air and to control the moving speed of the piston by the pulling device 153. In this case, the thrusting roller 152 in the first embodiment can be omitted.

That is, as shown in the drawing, to the rear end of the coating hose 14 are provided a selector valve 174 for supplying the compressed air and a selector valve 175 for de-pressuring the rear part of the piston 14. When the selector valve 174 is opened to supply the compressed air to the rear part of the piston 14, the piston 14 is driven to move forward. At this time, the moving speed of the piston 14 is controlled by loosening the cable 151 of the pulling device 153. Further, it is desirable to control the pressure of the compressed air supplied from the selector valve 174 in accordance with the resistance of the coating material P filled in the front part of the piston 14. For example, the resistance of the piston 14 due to the coating material P becomes larger as the piston 14 moves closer to the backward limit position, and the resistance of the piston 14 becomes smaller as the piston 14 moves closer to the coating gun 11. The pressure of the compressed air is also controlled in accordance with this resistance.

In case of returning the piston 14 from the forward limit position to the backward limit position, the selector valve 174 is closed to stop supply of the compressed air, and the selector valve 175 is opened to remove the air existing in the rear part of the piston 14 from this valve.

<Fourth Embodiment>

Figure 7:
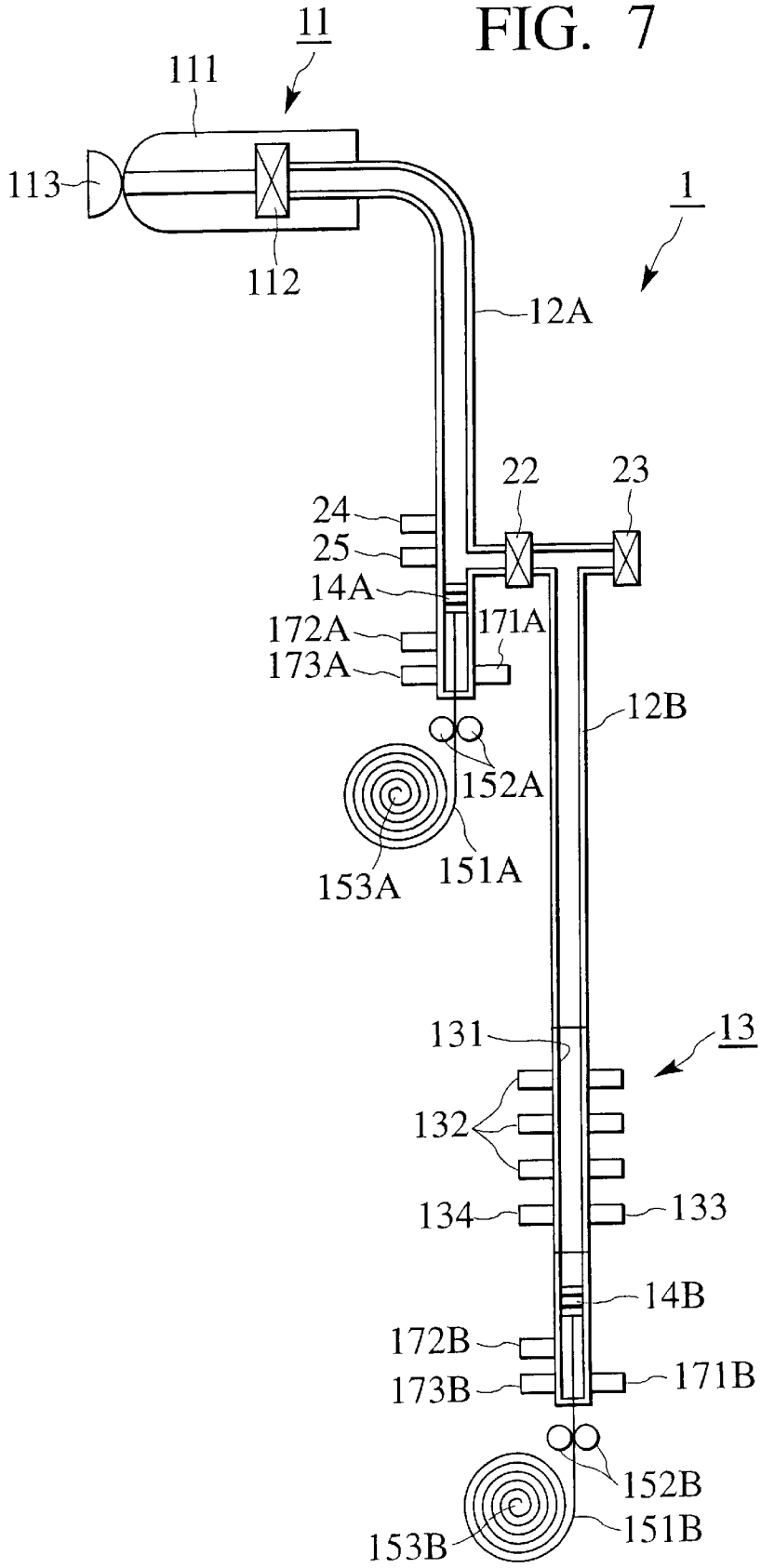
FIG. 7 is a schematic block diagram showing yet another embodiment of the coating apparatus according to the present invention.

FIG. 7 shows a schematic block diagram showing yet another embodiment of the coating apparatus according to the present invention. In the coating apparatus 1 of this embodiment, the coating material supply system is divided into two in order to shorten the time required for changing a color or supplying the coating material having a different color.

That is, the coating material supply system is divided into a first coating hose 12A for supplying the coating material to the coating gun 11 and a second coating hose 12B for supplying the coating material to the first coating hose 12A, and an opening/closing valve 22 is provided at a connection portion of these members.

A first piston 14A which water-tightly slides in the first coating hose 12A is provided to the first coating hose 12A, and the first piston 14A can move forward and backward by first thrusting rollers 152A and 152A and a pulling device 153A.

In FIG. 7, to the first coating hose 12A are provided a selector valve 24 for supplying washing de-ionized water for color change (when the coating material P is a water based coating material) and a selector valve 25 for supplying cleaning air for color change.

On the other hand, the above-described opening/closing valve 22 and a dumper valve 23 are provided to the end of the second coating hose 12B, thereby enabling disposal of the cleaning liquid to the outside of the system when the inside of the coating hose 12B is cleaned.

Any other structure is similar to that of the coating apparatus 1 of the first embodiment, and like reference numerals are given to constituent members common to the first embodiment. An alphabetic character "A" enabling identification as the first coating supply system is given to the tail end. Similarly, an alphabetic character "B" is given to the tail end of reference numeral for a member in the second coating supply system.

The operation of the coating apparatus 1 according to this embodiment will be described.

When both the first piston 14A and the second piston 14B are placed at the backward limit position shown in the drawing and the opening/closing valve 22 is opened, while the dump valve 23 is closed, the selector valve 132 of the color change valve unit 13 is switched to supply a predetermined amount of the coating material P from the second coating hose 12B to the first coating hose 12A. At this time, the trigger valve 112 is closed.

Subsequently, the second piston 14B is moved toward the opening/closing valve 22 by using the second thrusting roller 152B and the second pulling device 153B. When the second piston 14B passes the color change valve unit 13 and reaches the application enabling position, the trigger valve 112 is opened and a high voltage is applied to the coating gun. Here, the coating material P is filled in both the first coating hose 12A and the second coating hose 12B, but only the air exists in the rear part of the second piston 14B. Accordingly, the high voltage is blocked.

Moreover, when the second piston 14B is moved forward and the second piston 14B reaches the forward limit position very close to the opening/closing valve 22, the first piston 14A is moved toward the coating gun 11 by the first thrusting roller 152A and the first pulling device 153A. At the same time, the second thrusting roller 152B is released to be free and the second pulling device 153B is rotated in the reverse direction so that the second piston 14B is retracted.

When the first piston 14A reaches a position beyond the selector valve 24, the opening/closing valve 22 is closed to start cleaning of the inside of the second coating hose 12B. That is, the dump valve 23 is opened, and the selector valves 133 and 134 of the color change valve unit 13 are alternately opened/closed to alternately supply the washing de-ionized water and the thrusting air into the second coating hose 12B, thereby disposing of the cleaning liquid from the dump valve 23. Upon completion of cleaning, the operation waits for the next coating cycle at a backward limit position. In this standby mode, the first piston 14A continues to move toward the coating gun 11. When the first piston 14A reaches a position very close to the trigger valve 112 and coating is terminated, the first thrusting roller 152A is released to be free and the pulling device 153A is rotated in the reverse direction. Consequently, the first piston 14A is returned to the backward limit position. The selector valves 24 and 25 are alternately opened and closed and the washing de-ionized water and the thrusting air are alternately supplied into the first coating hose 12A, thus disposing of the cleaning liquid from the bell cup 113.

As described above, in the coating apparatus 1 according to this embodiment, when the first piston 14A is moved forward to perform coating, the inside of the second coating hose 12B can be cleaned and the next coating material having a different color can be supplied. Therefore, after completion of the coating cycle, only cleaning of the inside of the first coating hose 12A can suffice. In other words, since it is enough to perform cleaning and color change operations to one of all the coating hoses 12A and 12B, i.e., the coating hose 12A, the standby time required before start of the next coating process can be shortened.

<Fifth to Seventh Embodiments>

Figure 8:
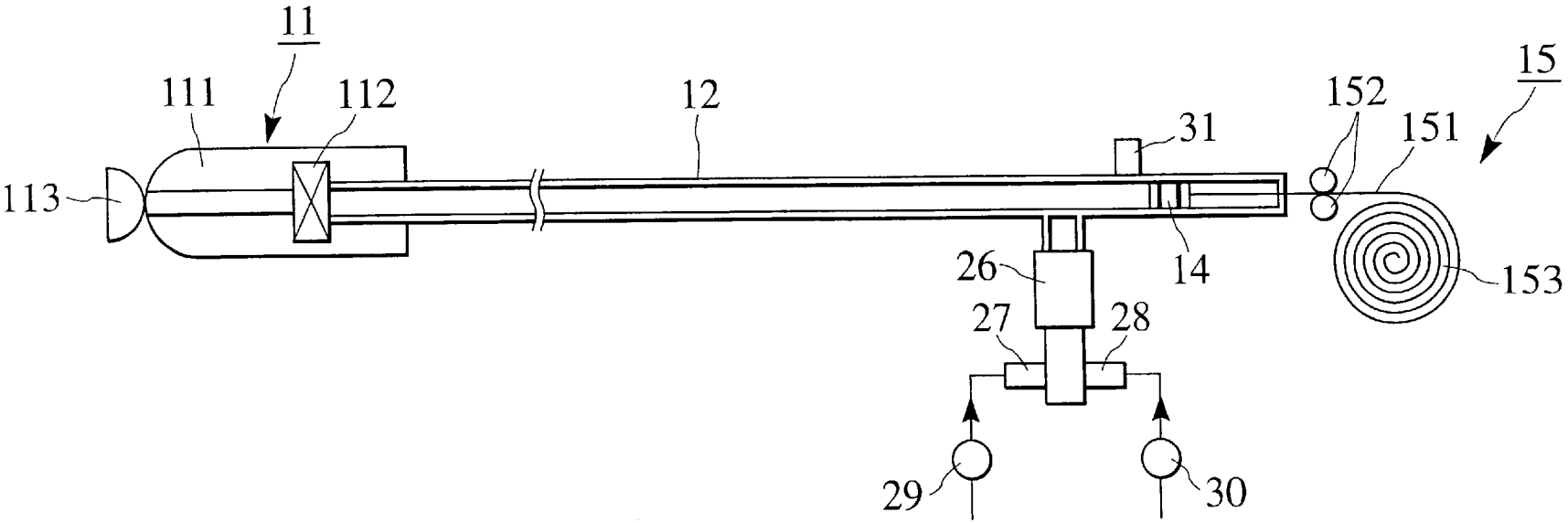
FIG. 8 is a schematic block diagram showing a further embodiment of the coating apparatus according to the present invention.
Figure 9:
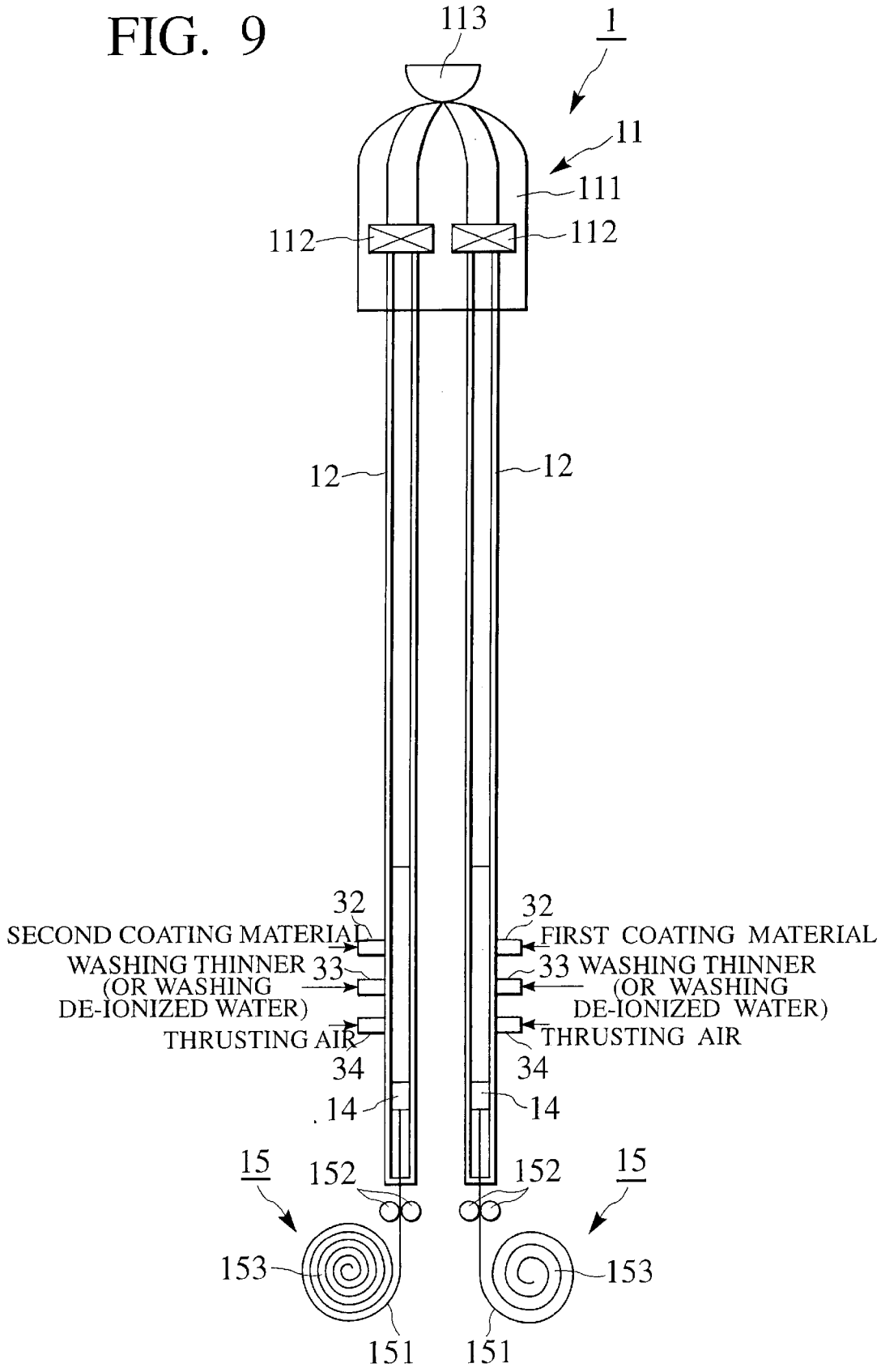
FIG. 9 is a schematic block diagram showing a still further embodiment of the coating apparatus according to the present invention.
Figure 10:
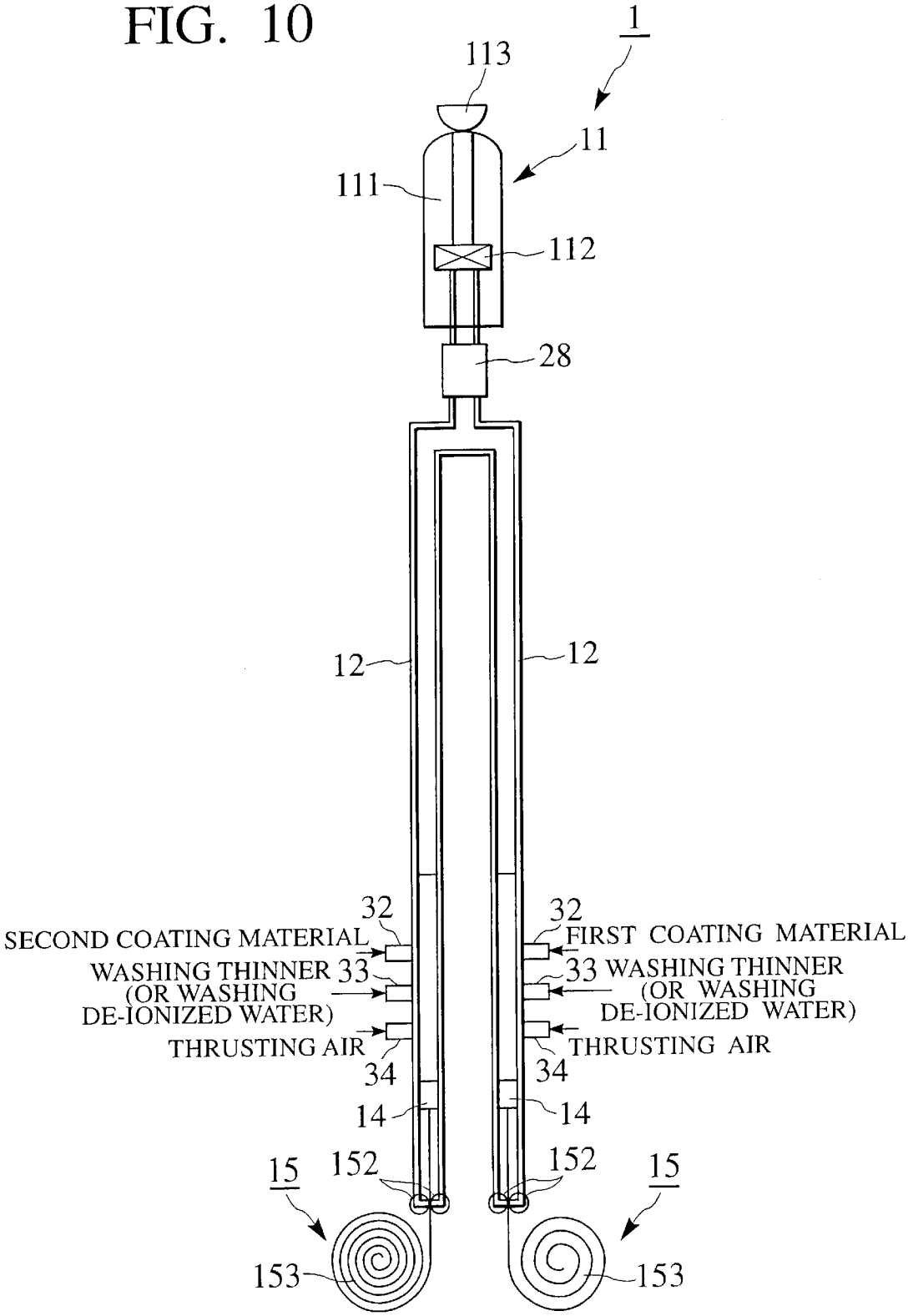
FIG. 10 is a schematic block diagram showing a yet further embodiment of the coating apparatus according to the present invention.

FIGS. 8 to 10 are schematic block diagrams showing further embodiments of the coating apparatus according to the present invention. The fifth to seventh embodiments are examples in which the coating apparatus according to the present invention is applied to a so-called two-color mixing type coating apparatus. For example, a white coating material and a black coating material are mixed at an arbitrary ratio from 100:0 to 0:100, and a gray coating material whose color is a neutral color of black and white is continuously produced to be applied to a coating object.

In the embodiment shown in FIG. 8, a mixer 26 is provided at a rear end of the coating hose 12, and a first coating material and a second coating material respectively having fixed amounts are supplied to the mixer 26 by gear pumps 29 and 30 through selector valves 27 and 28. The coating material mixed by the mixer 26 is supplied to a front part of the piston 14 in the coating hose 12 and further fed to the coating gun 11 to be applied onto a coating material, as in the first embodiment.

Incidentally, when the remaining air in the manifold becomes a problem, an air vent valve 31 can be provided at the rear end of the coating hose 12 to release air.

In the embodiment shown in FIG. 9, the coating materials having two colors are mixed in the bell cup 113 of the coating gun 11, and respective two pairs of coating hoses 12, pistons 14, thrusting rollers 152 and pulling devices 153 are provided to the coating gun 11 having two trigger valves 112 and 112. Three selector valves 32, 33 and 34 are provided to each coating hose 12 on the rear end side so that the cleaning thinner (or the washing de-ionized water), the thrusting air and the first or second coating material are respectively supplied.

In this embodiment, a coating supply system dedicated for each of the first and second coating materials is provided without using the mixer 26 in the embodiment shown in FIG. 8, and the coating material is directly supplied to the bell cup 113. Further, the both coating materials are mixed by utilizing the turning force of the bell cup 113.

In the embodiment shown in FIG. 10, there are provided respective two pairs of coating hoses 12, pistons 14, thrusting rollers 152 and pulling devices 153, and a mixer 26 is provided in the vicinity of the coating gun 11 in order to mix the coating materials having two colors in this mixer. Since the existing coating gun 11 can be used as it stands by doing so, reduction in the facility cost can be attained.

It is to be noted that the coating apparatus 1 according to each of the fifth to seventh embodiments can be applied to both the conductive coating material and the non-conductive coating material.

<Eighth Embodiment>

Figure 11:
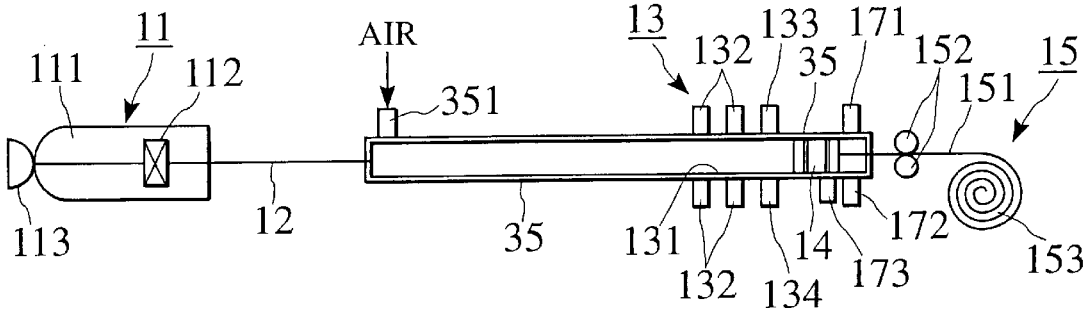
FIG. 11 is a schematic block diagram showing another embodiment of the coating apparatus according to the present invention.
Figure 12:
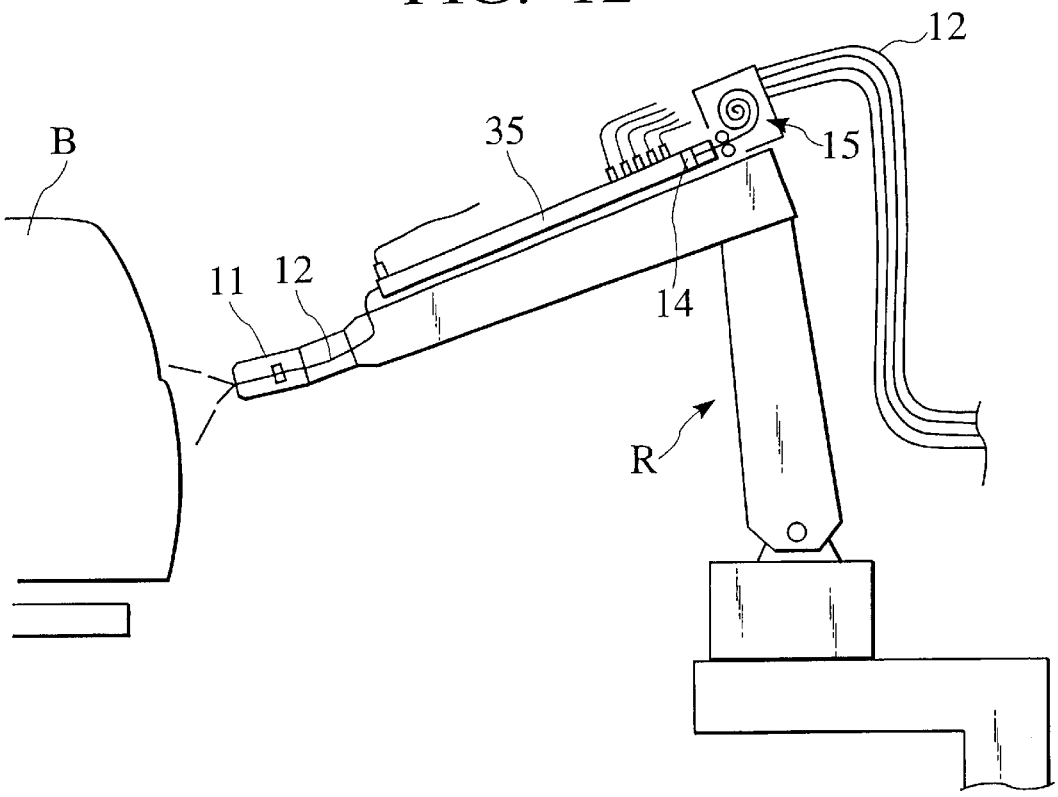
FIG. 12 is a schematic block diagram showing a use of the coating apparatus depicted in FIG. 11.

FIG. 11 is a schematic block diagram showing a still further embodiment of the coating apparatus according to the present invention, and FIG. 12 is a schematic block diagram showing a use of the coating apparatus depicted in FIG. 11.

Although the piston 14 can move forward and backward in the coating pipe 12 and the color change valve unit 13 in the foregoing first to seventh embodiments, the piston 14 can move forward and backward in a cylinder 35 and the color change valve unit 13 in this embodiment.

That is, the cylinder 35 is provided in the middle of the coating hose 12 for supplying the coating material to the coating gun 11, and the color change valve unit 13 is provided in the middle of the cylinder 35. Each end of the manifold 131 of the color change valve unit 13 is water-tightly connected to the cylinder 35 by a joint.

To the color change valve unit 13 shown in the drawing are provided a selector valve 132 to which a different coating material is supplied from a non-illustrated coating material supply source, a selector valve 133 to which the compressed air is supplied, and a selector valve 134 to which the washing de-ionized water (the washing thinner in case of the non-conductive coating material and so forth) is supplied. Although the four selector valves shown on the left-hand side in the drawing are selector valves 132 to which the coating material is supplied, a number of the selector valves 132 may be more or less than four and can be appropriately increased or decreased under various conditions such as a number of colors of the coating material in an applied coating line. It is to be noted that the compressed air supplied to the selector valve 133 is used for thrusting out the coating material or the washing de-ionized water at the time of color change and the washing de-ionized water supplied to the selector valve 134 is used for cleaning the pipe at the time of color change.

In the color change valve unit 13 according to this embodiment, the internal diameter of the manifold 131 is substantially equal to that of the cylinder 35. As a result, the piston 14 can smoothly move from the right side to the left side of the cylinder 35 through the manifold 131 of the color change valve unit 13.

In case of using the conductive coating material as the coating material, although the present invention does not restrict materials, it is preferable to form the cylinder 35 and the manifold 131 of the color change valve unit 13 by an insulating material such as a synthetic resin. When the cylinder 35 or the manifold 131 is formed of the conductive material such as metal, the electric current may leak from the cylinder 35, the manifold 131 and the selector valves 132, 133 and 134 to the coating material supply source through the conductive coating material.

In the coating apparatus 1 according to this embodiment in particular, there are provided the piston 14 which can water-tightly slide from the right end to the left end of the cylinder 35 through the manifold 131 of the color change valve unit 13 and driving means 15 for moving the piston 14 at an appropriate position and an appropriate speed.

As shown in FIG. 2 in large, the piston 14 is constituted by mounting two O rings 142 which consist of an insulating material and prevent the leakage of the coating material to the piston main body 141 which also consists of an insulating material, as in the first to seventh embodiments. A length of the piston main body 141 in the axial direction is shortened as much as possible so that the piston can move smoothly even if the coating hose 12 is bent. It is preferable to form the piston main body 141 by an insulating material such as nylon which can not be degraded by water or a solvent. The O ring 142 consists of a material such as rubber having the appropriate elasticity and is preferably constituted with a material having the excellent abrasion resistance and solvent resistance.

The O ring 142 assures water tightness of the coating material and the like in front or back of the piston 14 and also has a function for improving the sliding property of the piston 14. Moreover, the O ring has a function for scraping off the coating material having a previous color which has adhered to the inner wall of the cylinder at the time of color change.

The coating material is injected into the front part of the piston 14, and the piston 14 is moved toward the coating gun 11. Then, the conductive coating material which has adhered to the inner wall of the cylinder 35 can be scraped off toward the front part by the O ring 142. Therefore, only the air exists in the rear part of the piston 14. Accordingly, even if a high voltage is applied to the coating gun 11, the high voltage is blocked in front and back of the piston 14, which prevents the electric current from leaking toward the rear end of the cylinder 35.

As in the first embodiment, the driving means 15 for moving the piston 14 includes: a cable 151 having an end fixed to the piston main body 141; a pair of thrusting rollers 152 and 152 which are provided in the vicinity of the rear end of the coating hose 12 and rotate sandwiching the cable 151; and a pulling device 153 for taking up the cable 151.

It is to be noted that three selector valves 171, 172 and 173 are provided at the right end of the cylinder 35 in order to clean the inside of the cylinder 35 positioned at the rear of the piston 14. The washing thrusting air is supplied to the selector valve 171, and the washing thinner is fed to the selector valve 172. The selector valve 173 is a dump valve. Since the inside of the cylinder 35 at the rear of the piston 14 is mainly filled with the air and the slightly leaked coating material exists therein, the cylinder 35 at the rear of the piston 14 does not have to be cleaned by the selector valves 171 to 173 every time a color is changed. Such cleaning may be performed according to needs.

Although an air valve 351 is provided at the left end of the cylinder 35, the piston 14 moves forward from the right end to the left end of the cylinder 35, and the air valve 351 is opened to supply the compressed air when the piston reaches a position immediately before the left end. As a result, the coating material remaining in the coating hose 12 connected to the left end of the cylinder 35 can be supplied to the coating gun, thereby achieving the effective use of the coating material.

The coating apparatus 1 according to this embodiment having the above-described arrangement is mounted in a coating robot R to be used in a coating line 2 as shown in FIG. 12, for example. In the drawing, reference character "B" denotes an automotive body which is a coating object.

In the coating apparatus 1 of this embodiment, since the piston 14 moves in the cylinder 35 and the manifold 131 of the color change valve unit 13, the piston 14 can very smoothly move by forming the cylinder 35 and the manifold 131 by linear members having the rigidity even if the coating hose 12 is bent with the movement of the robot R. Also, a discharge amount of the coating material can be fixed and stabilized.

It is to be noted that the foregoing embodiments are given for easily understanding the present invention but not for restricting the present invention. Therefore, each constituent part disclosed in the above embodiments is intended to include all modifications and equivalents of design which fall within the technical scope of the present invention.

The entire contents of Japanese Patent Application No. 2000-72426, filed on Mar. 15, 2000, and Japanese Patent Application No. 2001-36482, filed on Feb. 14, 2001, are hereby incorporated by reference.

What is claimed is:

1. A coating apparatus comprising:

a coating gun to which a voltage is applied;

a coating pipe for leading a coating material to said coating gun;

a piston provided so as to be capable of water-tightly sliding in said coating pipe; and a drive portion including a cable having one end connected to said piston and moving said piston through said cable in said coating pipe, said coating material being injected into a front part of said piston and said piston being moved toward said coating gun at the time of coating.

2. The coating apparatus according to claim 1, wherein a color change valve unit is provided in the middle of said coating pipe, and an internal diameter of a common outlet flow path of said color change valve unit is substantially equal to that of said coating pipe.

3. The coating apparatus according to claim 2, wherein said piston is stopped at least at a backward limit position set at the rear of said color change valve unit, a forward limit position set immediately before a trigger valve of said coating gun, and an application enabling position set in front of said color change valve unit.

4. The coating apparatus according to claim 3, wherein an operation for changing a previous color is carried out, with said piston being stopped at said backward limit position.

5. The coating apparatus according to claim 1, wherein said drive portion further comprises:

thrusting rollers which sandwich said cable and move said piston toward said coating gun; and a pulling device which is connected to the other end of said cable and moves said piston in a direction opposite to said coating gun.

6. The coating apparatus according to claim 5, wherein a pressure by an insulating fluid is applied from a rear part of said piston, when said piston is moved toward said coating gun.

7. The coating apparatus according to claim 6, wherein a pressure of an insulating fluid applied to a rear part of said piston is controlled in accordance with a target moving speed of said piston.

8. The coating apparatus according to claim 1, wherein said drive portion is provided outside a coating booth.

9. The coating apparatus according to claim 1, wherein said coating material is a conductive coating material.

* * * * *